US005655487A

United States Patent [19]

Maas et al.

[11] Patent Number: 5,655,487

[45] Date of Patent: Aug. 12, 1997

[54] SWITCHABLE SUPPORT ELEMENT

[75] Inventors: Gerhard Maas, Herzogenaurach; Michael Haas, Weisendorf, both of Germany

[73] Assignee: Ina Walzlager Schaeffler KG, Germany

[21] Appl. No.: 647,930

[22] PCT Filed: Feb. 12, 1994

[86] PCT No.: PCT/EP94/04007

§ 371 Date: May 28, 1996

§ 102(e) Date: May 28, 1996

[87] PCT Pub. No.: WO95/16851

PCT Pub. Date: Jun. 22, 1995

[30] Foreign Application Priority Data

Dec. 17, 1993 [DE] Germany ..... 93 19 435.8

[51] Int. Cl.[6] ..... F01L 1/34; F01L 1/24; F02D 13/02

[52] U.S. Cl. ..... 123/90.16; 123/90.41; 123/90.43; 123/90.46

[58] Field of Search ..... 123/90.15, 90.16, 123/90.39, 90.4, 90.41, 90.42, 90.43, 90.45, 90.46

[56] References Cited

U.S. PATENT DOCUMENTS 5,357,916 10/1994 Matterazzo ..... 123/90.16
5,386,806 2/1995 Allen et al. ..... 123/90.16
5,419,290 5/1995 Hurr et al. ..... 123/90.16
5,501,186 3/1996 Hara et al. ..... 123/90.16

FOREIGN PATENT DOCUMENTS 2535390 5/1984 France .
4211631 4/1993 Germany .

OTHER PUBLICATIONS

Patent Abstracts of Japan, vol. 10, No. 304, Jun. 1986 Publication No. JP61118518 (1 page).

Patent Abstracts of Japan, vol. 10, No. 304, Jun. 1986 Publication No. JP61118514 (1 page).

*Primary Examiner*—Weilun Lo
*Attorney, Agent, or Firm*—Bierman, Muserlian and Lucas LLP

[57] ABSTRACT

A switchable support element for a lever valve drive of an internal combustion engine comprising a hollow cylindrical housing arranged with an outer peripheral surface in a reception bore of a cylinder head, an inner element supported on the housing by a compression spring being arranged for axial displacement within the housing, while one front end of the housing or of the inner element bears at least indirectly against a finger lever and a second front end bears against he cylinder head.

10 Claims, 3 Drawing Sheets

Figure 1:
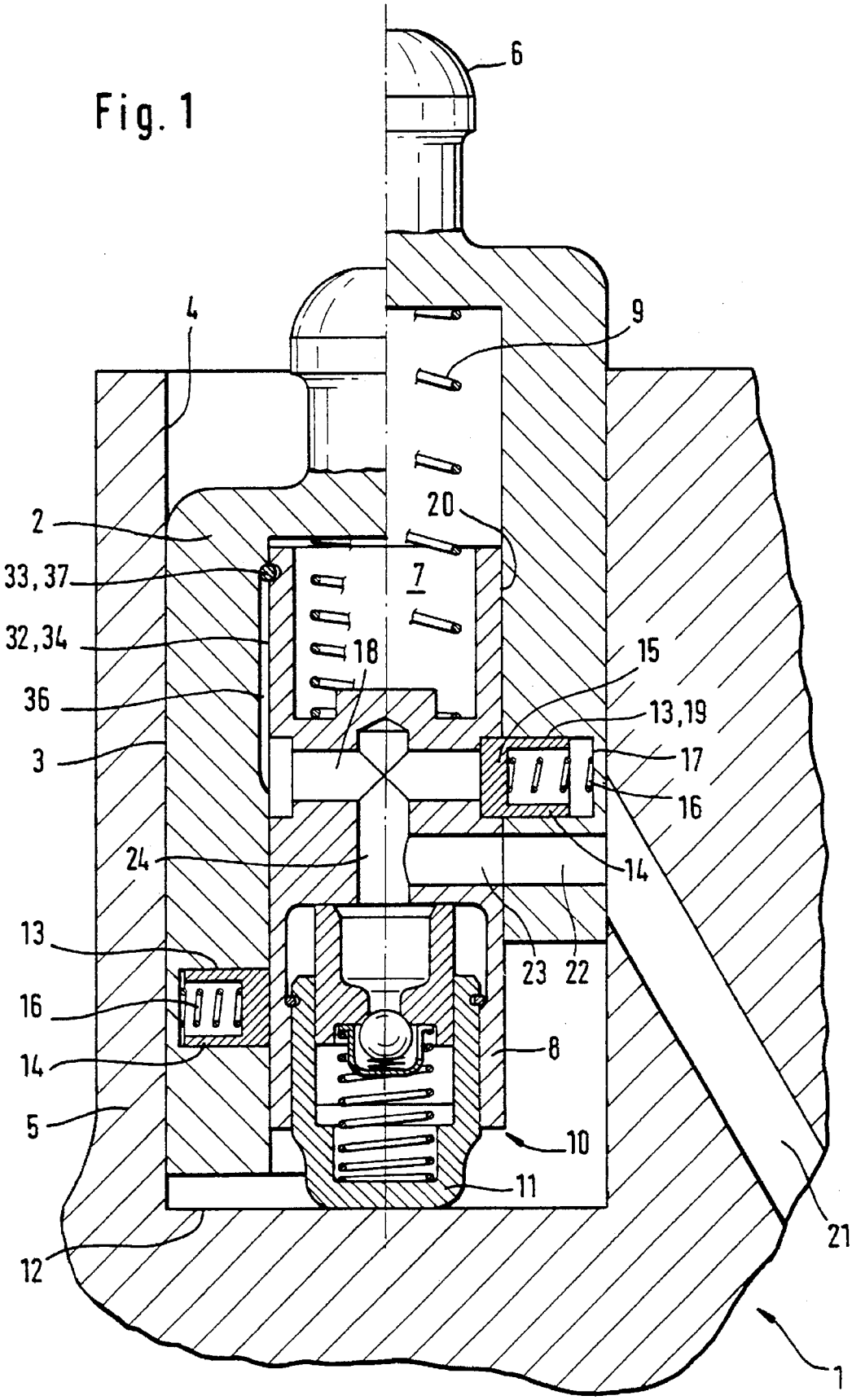

30
29
28
31
32
8
22
18
13
14
27
2
23
21
5
1

SWITCHABLE SUPPORT ELEMENT

The invention concerns a switchable support element for a lever valve drive of an internal combustion engine comprising a hollow cylindrical housing arranged with an outer peripheral surface in a reception bore of a cylinder head, an inner element supported on the housing by a compression spring being arranged for axial displacement within the housing, while one front end of the housing or of the inner element bears at least indirectly against a finger lever and a second front end bears against the cylinder head, the housing and the inner element each comprising at least one radial or tangential bore aligned with each other in a base circle phase of a cam, a coupling means in form of a piston is arranged in at least one of the said bores while being displaceable in bore direction so that in a coupled state, the piston bridges an annular gap between the housing and the inner element thus causing a positive engagement therebetween, and a coupling and an uncoupling of the two elements concerned being effected optionally by a spring force or by a hydraulic medium.

A device of the aforesaid type, known from WO-A-91/12 415, likewise comprises an inner element arranged for axial displacement in a housing. Two pistons serving as coupling means are associated with the inner element. To effect coupling, hydraulic medium can be fed to the pistons from the base of a bore of housing. A basic drawback of this construction is that the support element in conjunction with the associated levered drive is of a rather complicated design to enable it to achieve at least two different lifting curves. Thus, for example, this prior art solution comprises two cams with differing lifts which act on at least two finger levers one of which is supported on a support element of the generic type. A further drawback of the known support structure is that the arrangement and configuration of the coupling means results in a relatively large overall axial height of the support element. Moreover, the prior art document discloses no measures, for example, for coupling the housing and the inner element in the absence of hydraulic medium pressure, and no concrete means for a supply of hydraulic medium to the coupling elements are described.

It is therefore an object of the invention to provide an improved support element of the initially mentioned type in which the aforesaid drawbacks are eliminated and which particularly comprises a coupling mechanism using simple means and functioning reliably both in the presence and in the absence of hydraulic medium pressure.

The invention achieves this object by the fact that the spring force is produced by a compression spring which is supported at one end on a base of a bore of the housing and whose second end acts on a front end of the piston which, in the uncoupled state of the housing and the inner element, is arranged for axial displacement in the bore of the housing and to accomplish coupling, engages by parts of its outer peripheral surface into the bore of the inner element. The pistons described here permit a reliable positive locking and unlocking between the housing of the support element and its inner element. Advantageously, two locking pistons are used, but it is also conceivable to use several locking elements spaced along the length of the support element to permit a graduated switching to smaller valve lifts. It is likewise possible to configure the pistons merely as indirect coupling means which act on direct coupling means such as sliders. It is possible in all envisaged embodiments to provide for a displacement of the coupling means at least partially in an axial direction. Needles, wedges and the like may also be used as coupling means. The bores then have any required shape so that they can be regarded, in general, as recesses for the coupling means.

The scope of protection of the switching device of the invention also covers insertion elements for rocker arms, bridge-type drives for simultaneous actuation of two gas exchange valves, and the like. The invention likewise envisages the arrangement of the switching element on the bearing of a rocker arm.

Modifications of the invention include a coupling by a compression spring mechanism which loads the piston mounted together with the piston in the housing or with the compression spring and the piston mounted in the inner element or a tension spring mechanism which can be installed optionally in the inner element or the housing.

Methods of force application other than those described in the Claims, for example, magnetic, electromagnetic, pneumatic, purely mechanical means and combinations of these methods are also conceivable. A coupling of the housing with the inner element by spring force results in a support element which is in a stand-by condition in the switched-off state of the internal combustion engine. This is advantageous, for example, when all the cylinders are completely switched off because, otherwise, when re-starting the engine, the oil pressure would be insufficient for a displacement of the pistons in the support element. A coupling by means of oil pressure is advantageous, for example, when, in the case of multi-valve cylinders, only one inlet valve of each cylinder has to be deactivated, for instance at low rotational speeds or loads, because at such speeds, only a low oil pressure exists in any case.

In all the embodiments of the invention depicted herein, only a low oil pressure and a small volume of oil are required for coupling and uncoupling operations so that it is possible to utilize the oil pump already provided in the internal combustion engine. The clearance compensation element in all the proposed embodiments may be arranged above or below the locking elements.

The support element of the invention may also be a purely mechanical element. However, it is advantageous, as stated in a further dependent claim, to combine it with a hydraulic clearance compensation element which can be supplied with hydraulic medium in common with or separately from the pistons.

Some preferred examples of embodiments of the invention are represented in the drawings.

Figure 2:
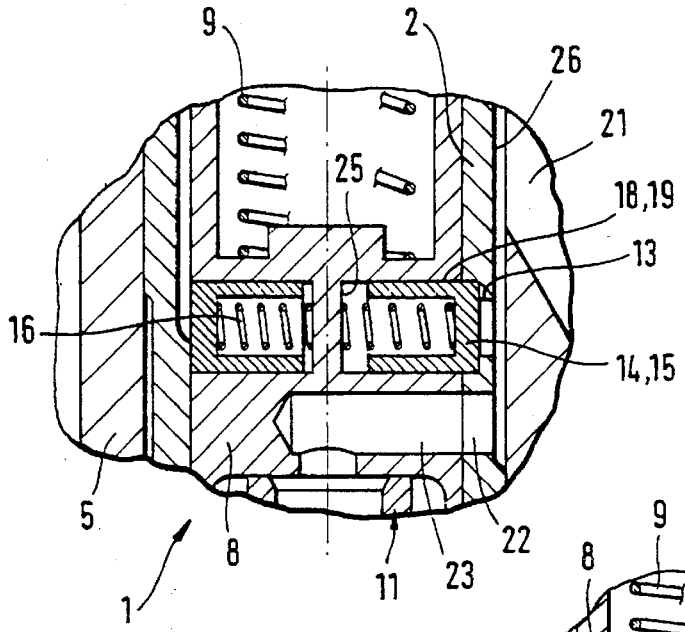
Figure 3:
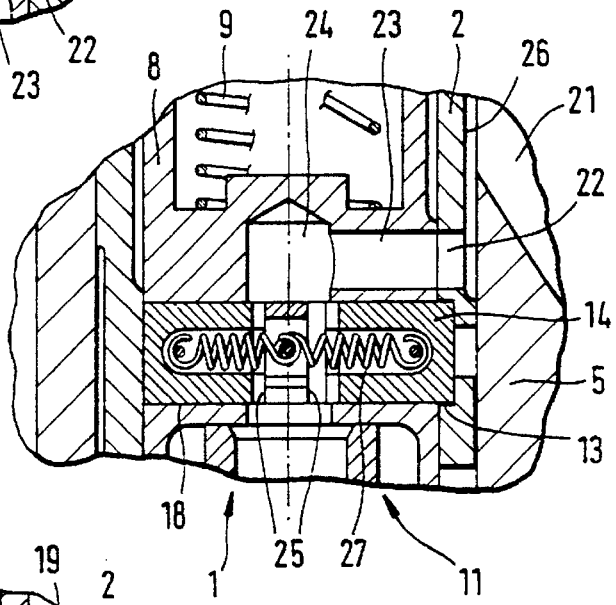
Figure 4:
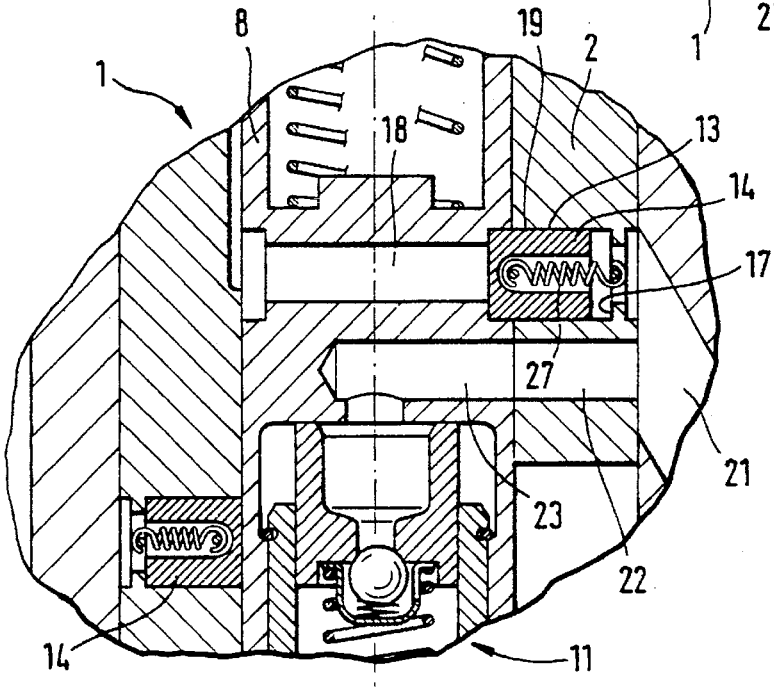
Figure 5:
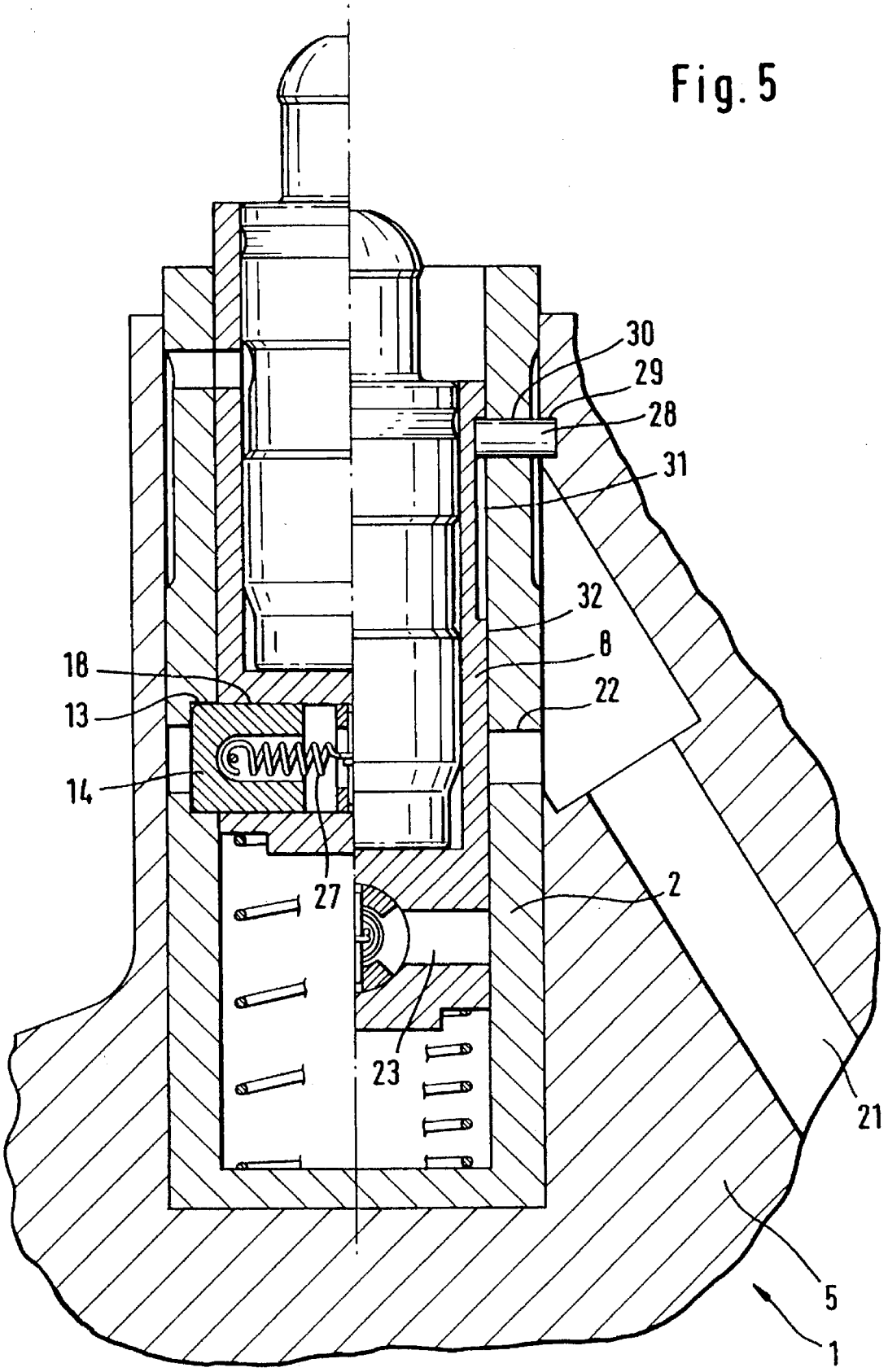

FIG. 1 is a longitudinal cross-section through a switchable support element of the invention with locking effected through a compression spring and piston, and a separate supply of hydraulic medium to the clearance compensation element, FIG. 2 shows a modification of the locking arrangement of FIG. 1, FIG. 3 shows a locking arrangement using tension springs, and a common supply of hydraulic medium to the clearance compensation element, FIG. 4 is a view of a locking arrangement using tension springs, and a separate supply of hydraulic medium to the clearance compensation element, and FIG. 5 is a longitudinal cross-section through another embodiment of the support element comprising a locking device with tension springs.

FIG. 1 shows a longitudinal cross-section through a switchable support element 1 of the invention for a finger lever of a valve drive of an internal combustion engine. The support element 1 comprises a hollow cylindrical housing 2 which is arranged for longitudinal displacement with its outer peripheral surface 3 in a reception bore 4 of a cylinder head 5. The support element 1 can also be used as an insert in a rocker arm, in which case, the end 6 of the insert element 1 would act on a valve tappet or a valve stem and not, as in the present case, on the end of a finger lever, not shown.

An inner element 8, which is likewise axially displaceable, is arranged in the interior 7 of the housing 2 and supported thereon by a compression spring 9. A front end 10 of the inner element 8 opposite to the end 6 of the housing 2 is supported by a hydraulic clearance compensation element 11 on a base 12 of the reception bore 4.

Two diametrically opposite bores 13 of the housing 2 each lodge a piston 14 having a bottom or front end 15 oriented radially inwards. These pistons 14 are biased radially towards the interior 7 by a compression spring 16. One end of the compression spring 16 is supported on the base 17 of the bore 13 while the other end acts on the bottom 15 of the piston 14. The inner element 8 likewise comprises a radial bore 18. The right half of FIG. 1 shows the support element 1 in the coupled state in which it acts in a manner similar to known support elements enabling a cam lift to be transmitted to a gas exchange valve via the finger lever (not shown). A coupling of the inner element 8 with the housing 2 is effected by the fact that, in the base circle phase of the cam in which the bore 18 is aligned with the bores 13, the peripheral surfaces 19 of the pistons 14 arranged in the housing 2 are caused to engage partially into the bore 18 by the force of the compression springs 16 thus bridging an annular gap 20 between the elements 2 and 8 and leading to a positive locking of these elements 2, 8 with each other.

When an uncoupling of these elements 2, 8 is required, for example at lower rotational speeds or loading of the internal combustion engine, the pistons 14 can be loaded by hydraulic medium in opposition to the force of their compression springs 16. For this purpose, a duct 21 is provided in the cylinder head and is aligned, at least in the base circle phase of the cam, with a radial bore 22, 23 extending below the bore 18 through the housing 2 and the inner element 8. The bore 22, 23 opens into an axial bore 24 of the inner element 8 and enables a common supply of hydraulic medium to the clearance compensation element 11 and the pistons 14. The left half of FIG. 1 shows the support element 1 of the invention in the uncoupled state. In the base circle phase of the cam, a throttling arrangement, not shown, permits the undiminished oil pressure of the duct 21 to act via the bores 22, 23, 24 and 18 on the pistons 14 so that they are pushed outwards into their bores 13. The housing 2 now performs an idle stroke relative to the inner element 8 with the result that the gas exchange valve concerned remains closed, or opens only slightly. During this time, the compression spring 9 retains the housing 2 in place against the finger lever and thus also against the control cam. In the coupled state of the elements 2, 8, the throttling arrangement permits the establishment of an appropriate oil pressure in the duct 21 to enable an adequate supply to the clearance compensation element 11.

FIG. 2 shows an alternative embodiment to that of FIG. 1, with the bore 18 of the inner element 8 in which the pistons 14 are arranged not being configured as a through-bore. The compression springs 16 are supported on the base 25 of the bore 18 and act radially outwards on the front end 15 of each piston 14. The right half of FIG. 2 shows a piston 14 in the coupled state which is achieved by the fact that a part of the outer peripheral surface 19 of the piston 14 extends into an associated radial bore 13 of the housing 2. The radial bore 22, 23 for supply of hydraulic medium to the clearance compensation element 11 is arranged below the bore 18. Hydraulic medium for the pistons 14 and the clearance compensation element 11 is transferred to the bores 13 and the bores 22, 23 via an annular groove 26 which communicates with the supply duct 21. For an uncoupling of the elements 2 and 8, the previously reduced pressure of the hydraulic medium is restored causing the pistons 14 to be pressed inwards against the force of their compression springs 16. The elements 2 and 8 are now physically uncoupled from each other, and the housing 2 effects an idle stroke.

In the embodiment of FIG. 3, the pistons 14 are likewise arranged in the bore 18 of the inner element 8. However, in this case, the pistons 14 are loaded radially inwards by the force of tension springs 27 fixed to the base 25 of the bore 18. A coupling of the two elements 2 and 8 (see right half of the Figure) is effected against the force of the tension springs 27 by the pressure of the unthrottled hydraulic medium in the base circle phase of the cam. In this phase, the pistons are loaded by hydraulic medium transferred from the supply duct 21 through the annular groove 26 to the radial bores 22, 23 and the axial bore 24, with a simultaneous supply of hydraulic medium to the clearance compensation element 11.

In the embodiment of FIG. 4, the pistons 14 are again arranged in the bore 13 of the housing 2. A tension spring 27 fixed to the base 17 of the bore 13 loads the piston 14 radially outwards, i.e. in the uncoupling direction so that when the pressure of the hydraulic medium coming from the supply duct 21 is throttled, the elements 2, 8 are unlocked from each other. The bore 13 in this embodiment is configured with an opening to permit a direct supply of hydraulic medium radially from the outside. The supply of hydraulic medium to the clearance compensation element 11 is effected via a separate passage 22, 23 extending below the bore 18 of the inner element 8. When the throttling of the pressure of the hydraulic medium is neutralized during the base circle phase of the cam, the pistons 14 are pushed against the force of the tension springs 27 radially inwards and engage by a part of their peripheral surfaces 19 into the bore 18 of the inner element 8. The support element 1 now performs its actual function, i.e. the opening of the associated gas exchange valve over the entire length of its defined valve lift.

FIG. 5 shows a support element 1 fixed by its housing 2 in a cylinder head 5. The description of the support element 1 will be limited to its novel features only. The hydraulic clearance compensation element is of a type known per se. The pistons 14 are arranged in the bore 18 of the inner element 8 and each piston 14 is biased radially inwards by a tension spring 27. The sectional plane of the left half of the figure showing the piston 14 is angularly offset to the plane of the right half. For a coupling of the inner element 8 to the housing 2, the pistons 14 are loaded radially outwards in the base circle phase of the cam via the supply duct 21 and the transverse bores 22, 23 against the force of the tension springs 27 so that the pistons 14 then extend partially into the bore 13 of the housing 2. A return motion of the pistons 14 is effected as already described by a reduction of pressure of the hydraulic medium.

A securing of the elements 2, 8 against rotation relative to each other and to the cylinder head 5 can be assured in this and other embodiments by a pin 28 which, in this embodiment, extends through aligned radial bores 29 and 30 of the cylinder head 5 and the housing 2 respectively, and projects into an axial groove 31 on the outer peripheral surface 32 of the inner element 8.

The hydraulic clearance compensation in this and other embodiments of the switchable support element 1 of the invention described herein may be replaced by a compensation of clearance by mechanical means. It is also conceivable to establish a positive engagement between the support element 1 and the rocker arm by a clasp or similar means (not shown) surrounding the end 6 of the housing 2.

A limitation of the uncoupling motion of the inner element 8 relative to the housing 2 can be effected in all the embodiments of the support element 1 of the invention by a stopping device 33 (see FIG. 1) formed, for example, by a bore 34 of the housing 2 comprising a recess 36 which acts as a stop for a ring 37 arranged on the outer peripheral surface 32 of the inner element 8.

We claim:

1. A switchable support element (1) for a lever valve drive of an internal combustion engine comprising a hollow cylindrical housing (2) arranged with an outer peripheral surface (3) in a reception bore (4) of a cylinder head (5), an inner element (8) supported on the housing (2) by a compression spring (9) being arranged for axial displacement within the housing (2), while one front end of the housing (2) or of the inner element (8) bears at least indirectly against a finger lever and a second front end bears against the cylinder head (5), the housing (2) and the inner element (8) each comprising at least one radial or tangential bore (13, 18) aligned with each other in a base circle phase of a cam, a coupling means in the form of a piston (14) is arranged in at least one of said bores (13, 18) while being displaceable in a bore direction so that in a coupled state, the piston (14) bridges an annular gap (20) between the housing (2) and the inner element (8) thus causing a positive engagement therebetween, a coupling and an uncoupling of the housing (2) and the inner element (8) being effected optionally by a spring force or by a hydraulic medium, characterized in that the spring force is produced by a compression spring (16) which is supported at one end on a base (17) of the bore (13) of the housing (2) and whose second end acts on a front end (15) of the piston (14) which, in the uncoupled state of the housing (2) and the inner element (8), is arranged for axial displacement in the bore (13) of the housing (2) and to accomplish coupling, engages by parts of an outer peripheral surface (19) thereof into the bore (18) of the inner element (8) (FIGS. 1, 2).

2. A switchable support element (1) for a lever valve drive of an internal combustion engine comprising a hollow cylindrical housing (2) arranged with an outer peripheral surface (3) in a reception bore (4) of a cylinder head (5), an inner element (8) supported on the housing (2) by a compression spring (9) being arranged for axial displacement within the housing (2), while one front end of the housing (2) or of the inner element (8) bears at least indirectly against a finger lever and a second front end bears against he cylinder head (5), the housing (2) and the inner element (8) each comprising at least one radial or tangential bore (13, 18) aligned with each other in a base circle phase of a cam, a coupling means in the form of a piston (14) is arranged in at least one of said bores (13, 18) while being displaceable in a bore direction so that in a coupled state, the piston (14) bridges an annular gap (20) between the housing (2) and the inner element (8) thus causing a positive engagement therebetween, a coupling and an uncoupling of the housing (2) and the inner element (8) being effected optionally by a spring force or by a hydraulic medium, characterized in that the spring force is produced by the compression spring (16) extending in the bore (18) of the inner element (8), and, in the uncoupled state of the housing (2) and the inner element (8), the piston (14) which is loaded by the compression spring (16) is arranged for axial displacement in the bore (18) of the inner element (8) and to accomplish coupling engages by parts of an outer peripheral surface thereof into the bore (13) of the housing (2), characterized in that the compression spring (16) is supported at a radially inner end on a base (25) of the bore of the inner element (8), and loads the piston (14) radially outwards in a coupling direction in opposition to hydraulic medium pressure (FIG. 2).

3. A support element according to the generic part of claim 1, characterized in that the spring force is produced by a tension spring (27) which is fixed at one end on a central base (25, 17) of the bore (18, 13) of the inner element (8) or of the housing (2), and whose second end acts on the piston (14) which, in the uncoupled state of the housing (2) and the inner element (8), is arranged for axial displacement in the bore (18, 13) of the inner element (8) or of the housing (2) and to accomplish coupling, engages by parts of an outer peripheral surface (19) thereof into the bore (13, 18) of the housing (2) or of the inner element (8) (FIGS. 3 to 5).

4. A support element of claim 1 wherein the piston (14) can be loaded in opposition to the force of the compression spring (16) (FIGS. 1,2) or in opposition to the force of a tension spring (27) (FIGS. 3 to 5) by hydraulic medium present in the bores (18,13), and at least one member of the group consisting of the inner element (8) and the housing (2) comprises at least one of radial and axial bores (22,23,24) which, in the base circle phase of the cam, are supplied at least indirectly with hydraulic medium from a supply duct (21) arranged in the cylinder head (5).

5. A support element of claim 4 which acts hydraulically and wherein a second front end (10) of the inner element (8) is supported by a hydraulic clearance compensation element (11) on a base (12) of the reception bore (4) of the cylinder head (5), and the clearance compensation element (11) and the pistons (14) are supplied in common with hydraulic medium from radial bores (23, 22) of the inner element (8) and of the housing (2) which bores are aligned with each other in the base circle phase of the cam and open into an axial bore (24) of the inner element (8) to supply hydraulic medium to the clearance compensation element (11) and to the bore (18) in which the piston (14) is lodged (FIGS. 1, 3).

6. A support element of claim 4 which acts hydraulically and wherein a second front end (10) of the inner element (8) is supported by a hydraulic clearance compensation element (11) on a base (12) of the reception bore (4) of the cylinder head (5), and the clearance compensation element (11) and the bore (18) in which the piston (14) is lodged are supplied separately with hydraulic medium, the bores (23, 22) for supplying the clearance compensation element (11) extend through the inner element (8) and the housing (2), as seen in axial direction, below the bores (18, 13) for the pistons (14), and communicate, at least indirectly, during the base circle phase of the cam with the supply duct (21) of the cylinder head (5) (FIGS. 2, 4).

7. A support element of claim 1 comprising a stopping device (33) for limiting an uncoupling motion of the housing (2) and the inner element (8), wherein a recess (36) is arranged in a bore (34) of the housing (2) or on an outer peripheral surface (32) of the inner element (8) to act as a stop for a radially projecting element (37) arranged on the inner element (8) or on the housing (2).

8. A support element of claim 7 wherein the projecting element (37) is a ball or a ring fixed in the recess (36) of the inner element (8).

9. A support element of claim 1 comprising a device to prevent rotation of the inner element (8) relative to at least one member of the group consisting of the housing (2) and to the reception bore (4) of the cylinder head (5).

10. A support element of claim 9 wherein the device to prevent rotation comprises at least a pin (28) which extends through aligned radial bores (30, 29) of the housing (2) and the cylinder head (5) and projects into an axial groove (31) on the outer peripheral surface (32) of the inner element (8).

* * * * *